US010002602B2

(12) United States Patent
Wu et al.

(10) Patent No.: US 10,002,602 B2
(45) Date of Patent: Jun. 19, 2018

(54) METHOD AND SYSTEM FOR REDUCING FAN NOISE AND ELECTRONIC DEVICE USING THE SAME

(71) Applicant: Coretronic Corporation, Hsin-Chu (TW)

(72) Inventors: Shang-Hsuang Wu, Hsin-Chu (TW); Chih-Cheng Chou, Hsin-Chu (TW)

(73) Assignee: CORETRONIC CORPORATION, Hsin-Chu (TW)

( * ) Notice: Subject to any disclaimer, the term of this patent is extended or adjusted under 35 U.S.C. 154(b) by 0 days. days.

(21) Appl. No.: 15/371,424

(22) Filed: Dec. 7, 2016

(65) Prior Publication Data

US 2017/0243574 A1 Aug. 24, 2017

(30) Foreign Application Priority Data

Feb. 19, 2016 (TW) ..... 105105029 A

(51) Int. Cl.
*G10K 11/16* (2006.01)
*G10K 11/178* (2006.01)

(52) U.S. Cl.
CPC ..... *G10K 11/1788* (2013.01); *G10K 11/178* (2013.01); *G10K 2210/129* (2013.01); *G10K 2210/3025* (2013.01); *G10K 2210/3211* (2013.01)

(58) Field of Classification Search
CPC ..... G10K 11/1788; G10K 2210/129; G10K 2210/3025; G10K 2210/3211
USPC ..... 381/71.1–71.9, 71.11–71.14, 83, 98; 379/406.01, 406.05, 406.08; 181/201, 181/206, 266, 269; 415/119
See application file for complete search history.

(56) References Cited

U.S. PATENT DOCUMENTS 5,448,645 A 9/1995 Guerci
5,845,236 A 12/1998 Jolly et al.
5,995,632 A 11/1999 Okada
(Continued)

FOREIGN PATENT DOCUMENTS

CN 201438738 U 4/2010
CN 103067812 A 4/2013
(Continued)

*Primary Examiner* — Vivian Chin
*Assistant Examiner* — Friedrich W Fahnert
(74) *Attorney, Agent, or Firm* — Li-Jen Shen

(57) ABSTRACT

A noise-reducing fan system, comprising a motor, a fan body, a plurality of magnetic-inducing elements, a magnetic field generator and a noise-reducing sound source device, is provided. Here, the fan body is mounted on the motor. The fan body comprises a plurality of blades, on which the plurality of magnetic-inducing elements are disposed, respectively. The magnetic field generator, which may generate a magnetic field, is employed for driving the plurality of magnetic-inducing elements to vibrate the plurality of blades and generate a vibration sound, so that at least one portion of the noise emitted from the fan body as rotating may be counterbalanced. The noise-reducing sound source device is disposed on a predetermined position and may send out a noise-reducing sound, so that the noise-reducing sound may counterbalance at least the other portion of the noise emitted from the fan body as rotating.

18 Claims, 10 Drawing Sheets

(56) References Cited

U.S. PATENT DOCUMENTS

| | | | | |
|---|---|---|---|---|
| 6,188,770 | B1 * | 2/2001 | Okada | F04D 29/663 381/71.14 |
| 2011/0305347 | A1 * | 12/2011 | Wurm | G10K 11/178 381/71.1 |
| 2012/0145359 | A1 * | 6/2012 | Rich | H05K 7/20172 165/104.31 |
| 2013/0189130 | A1 * | 7/2013 | Chang | F04D 17/16 417/354 |

FOREIGN PATENT DOCUMENTS

| | | | |
|---|---|---|---|
| CN | 204613580 | U | 9/2015 |
| CN | 104976159 | A | 10/2015 |
| JP | 2005037447 | A | 2/2005 |
| TW | M301486 | U | 11/2006 |
| TW | 201322782 | A | 6/2013 |
| TW | I405909 | B | 8/2013 |
| TW | 201528250 | A | 7/2015 |

* cited by examiner

METHOD AND SYSTEM FOR REDUCING FAN NOISE AND ELECTRONIC DEVICE USING THE SAME

CROSS-REFERENCE TO RELATED APPLICATION

This application claims the priority benefit of Taiwan application Ser. No. 105105029, filed on Feb. 19, 2016. The entirety of the above-mentioned patent application is hereby incorporated by reference herein and made a part of this specification.

FIELD OF THE INVENTION

The invention relates to an active noise-reducing device and method, and more particularly to a device and method adapted for reducing fan noise.

BACKGROUND OF THE INVENTION

An active noise-reducing technology has been developed for a long time. It is possible to reduce, or even eliminate a noise generated from a noise source by an inverse sound source as generated by a speaker. The inverse sound source and the noise source are the same in their volume, but phases of sonic waves are completely contrary to each other, and thus, by wave motion's destructive interference principle, the noise may be reduced, even dispersed.

Since voice is a spherical wave motion, therefore, if reduction, even elimination of the noises in each position by the active noise-reducing manner is desired, it is often necessary to locate the noise source and the inverse sound source at the same spatial position, so that an effect may be achieved. If the position of the inverse sound source is different, the sonic waves' phases may not be counterbalanced completely, i.e. some position may occur cancellation interferences. The other positions may occur additive interferences.

However, the noise source and the inverse sound source usually locate at different spatial positions, therefore, the current active noise-reducing technology is only useful to reduce the noise at some specific spatial positions, incapable of reduce the noises in the whole space.

Such a technology is employed for reducing the noise generated by the fan's rotation. Such a noise is mostly generated from a turbulent flow caused by fan body's tail flow, in a conventional technology, the magnetic force is created to oscillate the fan body for generating another inverse sound source, so that it allows the noise source and the inverse sound source to be located at positions nearby each other, almost at the same position, and the active noise-reducing effect may be achieved.

However, it has been found that the employment of magnetic force for oscillating the fan body for generating an inverse sound source, taking an axial-flow fan, such as 105 mm×105 mm×32 mm, as an example. When the noise source's frequency is lower than 1000 Hz, in addition to resonant frequency of several fan body's structure, such a technology has a poor and irregular efficiency in conversion of electrical energy to sonic energy, and thus, it may be hard to use such a structure for effectively reducing fan's low-frequency noise.

The information disclosed in this "BACKGROUND OF THE INVENTION" section is only for enhancement understanding of the background of the invention and therefore it may contain information that does not form the prior art that is already known to a person of ordinary skill in the art. Furthermore, the information disclosed in this "BACKGROUND OF THE INVENTION" section does not mean that one or more problems to be solved by one or more embodiments of the invention were acknowledged by a person of ordinary skill in the art.

SUMMARY OF THE INVENTION

In view of the aforementioned problem, the conventional active noise-reducing technology still needs quite improvement in the noise-reducing effect. Therefore, an object of the present invention provides a hybrid active noise-reducing fan structure, wherein such a structure utilizes both the speaker and the fan body's vibration at the same time for generating a desired inverse sound source, in this way, the effect of active noise-reducing technology may be substantial improved.

Other advantages and objects of the invention may be further illustrated by the technical features broadly embodied and described as follows.

In order to achieve one or a portion of or all of the objects or other objects, an embodiment of the invention provides a noise-reducing fan system, comprising a motor; a fan body, mounted on the motor, and the fan body being driven and rotated by the motor, wherein the fan body comprises a plurality of blades; a plurality of magnetic-inducing elements, disposed on the plurality of blades, respectively; a magnetic field generator, capable of generating a magnetic field, for driving the plurality of magnetic-inducing elements to vibrate the plurality of blades and generate a vibration sound so as to counterbalance at least a portion of a noise emitted from the fan body as rotating; and a noise-reducing sound source device, capable of sending out a noise-reducing sound, and the noise-reducing sound source device being disposed on a predetermined position, so that the noise-reducing sound may counterbalance at least the other portion of the noise emitted from the fan body as rotating.

The invention also provides an electronic device, provided with the aforementioned noise-reducing fan system, further comprising a device body, and the noise-reducing fan system being mounted in the device body. In some applications, the electronic device further comprises a voice source controller, disposed in the device body; and a speaker, electrically connected to the voice source controller, for sending out a voice.

The invention also provides a method for reducing fan noise generated in its operation, wherein the fan comprises a fan body provided with a plurality of blades. The method comprises steps of acquiring a frequency, an amplitude and a phase of the noise; dividing the noise into a high-frequency noise and a low-frequency noise; and providing a first inverse sound and a second inverse sound, respectively, in accordance with the high-frequency noise and the low-frequency noise, as well as the amplitude and the phase of the noise, respectively, so that the high-frequency noise and the low-frequency noise may be counterbalanced. In one embodiment of the invention, the first inverse sound is a vibration sound generated by the plurality of blades of the fan body to be controlled. The second inverse sound is a noise-reducing sound sent out by a noise-reducing sound source device.

Other objectives, features and advantages of the invention may be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENTS

Figure 1B:
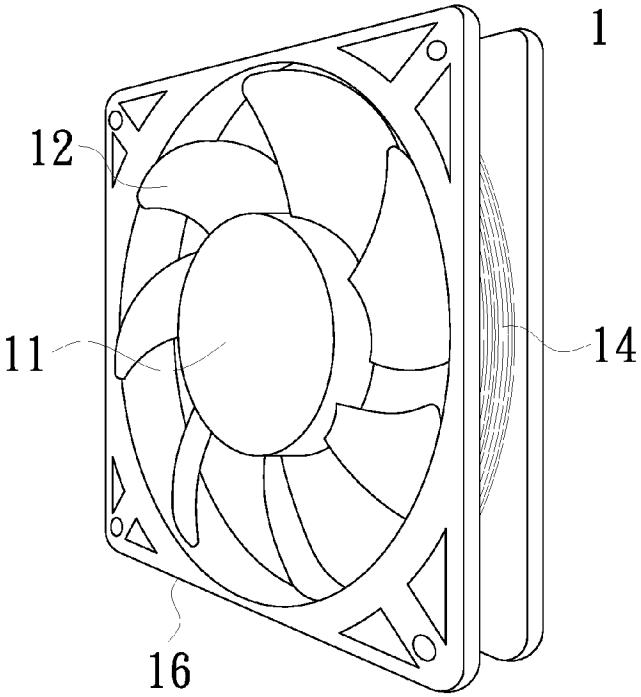
FIG. 1B is a schematic diagram depicting 3D structure of a noise-reducing fan system according to an embodiment of the invention.

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure(s) being described. The components of the invention may be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including", "comprising", or "having" and variations thereof herein is meant to encompassing the items listed thereafter and equivalents thereof as well as additional items. Unless limited otherwise, the terms "connected", "coupled", and "mounted" and variations thereof herein are used broadly and encompassing direct and indirect connections, couplings, and mountings. Similarly, the terms "facing", "faces", and variations thereof herein are used broadly and encompassing direct and indirect facing, and "adjacent to" and variations thereof herein are used broadly and encompassing directly and indirectly "adjacent to". Therefore, the description of "A" component facing "B" component herein may contain the situations that "A" component facing "B" component directly or one or more additional components is between "A" component and "B" component. Also, the description of "A" component "adjacent to" "B" component herein may contain the situations that "A" component is directly "adjacent to" "B" component or one or more additional components is between "A" component and "B" component. Accordingly, the drawings and descriptions may be regarded as illustrative in nature and not as restrictive.

When using a speaker as an inverse sound source for actively reducing noise, since the conversion efficiency of electrical energy to low-frequency sonic energy is high, the efficiency for processing low-frequency noise may be better than that of the active noise-reducing technology using fan vibration. In comparison with high-frequency noise, the low-frequency noise has a longer wavelength and a stronger penetrability. Thus, it is difficult to reduce low-frequency noise by a blocking method. However, as its longer wavelength, when the noise source and the inverse noise source locate at different spatial positions, most of the inverse sonic waves may still counterbalance the noise source and achieve the cancelling effects, and thus, it is suitable to reduce the low-frequency noise by use of the active noise-reducing technology with speaker. On the contrary, if a high-frequency noise signal is generated by the noise source, since its wavelength is shorter, when a distance between the inverse sound source and the noise source becomes larger, it may be difficult to reduce the noise through aligning the phases in all directions of sonic waves, i.e. it is ready to reduce the high-frequency noise at some spatial position. However, it may incur a higher-frequency noise at another position. That is, when the active noise-reducing technology is employed for reducing the high-frequency noise, the closer the spatial distance between the inverse sound source and the noise source, the better the effect of noise-reduction. And it may be difficult to achieve such an object through the active noise-reducing technology with speaker, on the other hand, under such circumstances, the inverse sound source generated by the fan body's vibration in the active noise-reducing technology is the better way to reduce the high-frequency noise. The concept of the invention's technology resides in that the above-described various active noise-reducing technology's advantages may be utilized and unified, for solving the problem of various noise-reducing technology's disadvantages.

Figure 1A:
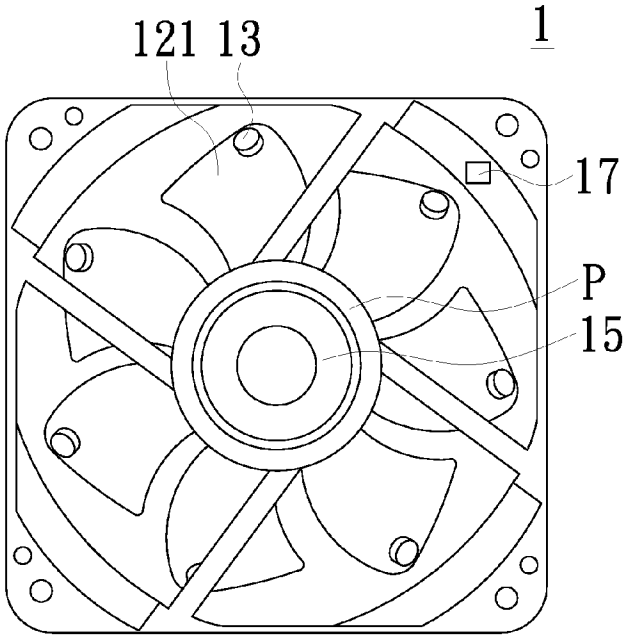
FIG. 1A is a schematic diagram depicting a lateral view of a noise-reducing fan system according to an embodiment of the invention.

Referring to FIG. 1A and FIG. 1B, a noise-reducing fan system 1 comprises a motor 11, a fan body 12, magnetic-inducing elements 13, a magnetic field generator 14, a noise-reducing sound source device 15 and a frame body 16. The fan body 12 is mounted on the motor 11, so that the motor 11 may drive and rotate the fan body 12. The fan body 12 comprises several blades 121, and each blade 121 is mounted with at least one of magnetic-inducing element 13. The magnetic field generator 14 is employing for generating an adjustable magnetic field, for driving the magnetic-inducing elements 13, vibrating the blades 121 and generating a vibration sound V (referring to FIG. 2A and FIG. 2B), so that counterbalance at least a portion of noise N (referring to FIG. 5C in advance) emitted from the fan body 12 as rotating. The noise-reducing sound source device 15 may be a speaker or any other sound source device with speaker's function, which is capable of sending out a noise-reducing sound S (referring to FIG. 2A and FIG. 2B) and disposed on predetermined position P, so that the noise-reducing sound S may counterbalance at least the other portion of the noise N emitted from the fan body 12 as rotating.

The frame body 16 of the noise-reducing fan system 1 encircles or surrounds the fan body 12, and the magnetic field generator 14 is winded around or attached to the frame body 16, for example, current coil, or any other device capable of generating an adjustable magnetic field. In this embodiment, the magnetic-inducing elements 13 may be a magnetic element, for example, magnet. Here, it is not intended to limit the magnet to a product made by magnetic ore, i.e. it may be any object or device which is capable of generating a magnetic field. It may generate an oscillating magnetic field, for example, via controlling the current's magnitude and direction in the coil, for acting on the magnetic-inducing elements 13 of the blades 121, so that blades 121 may be oscillated and generate vibration sound V from the friction of air flow and blades 121, for reducing a high-frequency noise, may be sent out. The noise-reducing sound source device 15 may be mounted at a position nearby the noise-reducing fan system 1, for example, as shown in FIG. 1A and FIG. 1B, the noise-reducing sound source device 15 is mounted on the center of the frame body 16, that is, a centric position of the whole noise-reducing fan system 1.

Figure 2A:
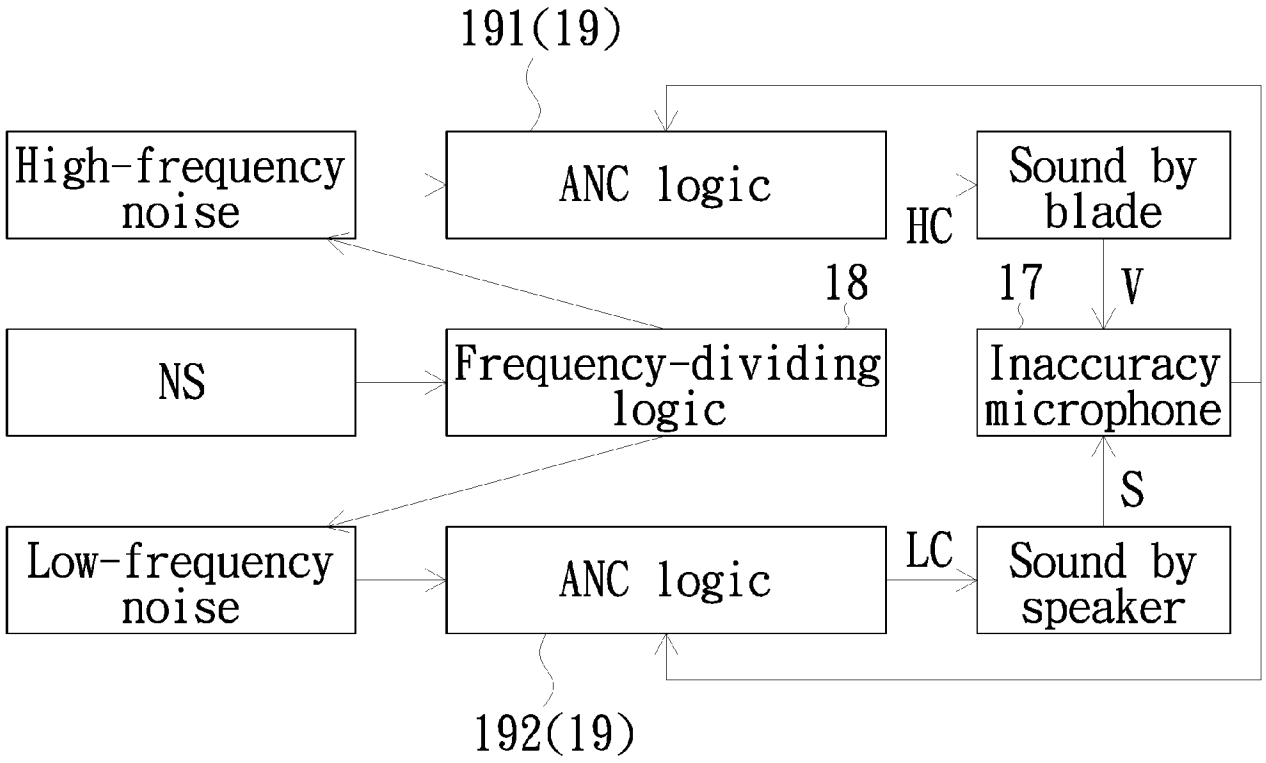
FIG. 2A is a schematic diagram depicting some device's functions and a flow chart of signal processing of a method for reducing fan noise according to an embodiment of the invention.
Figure 2B:
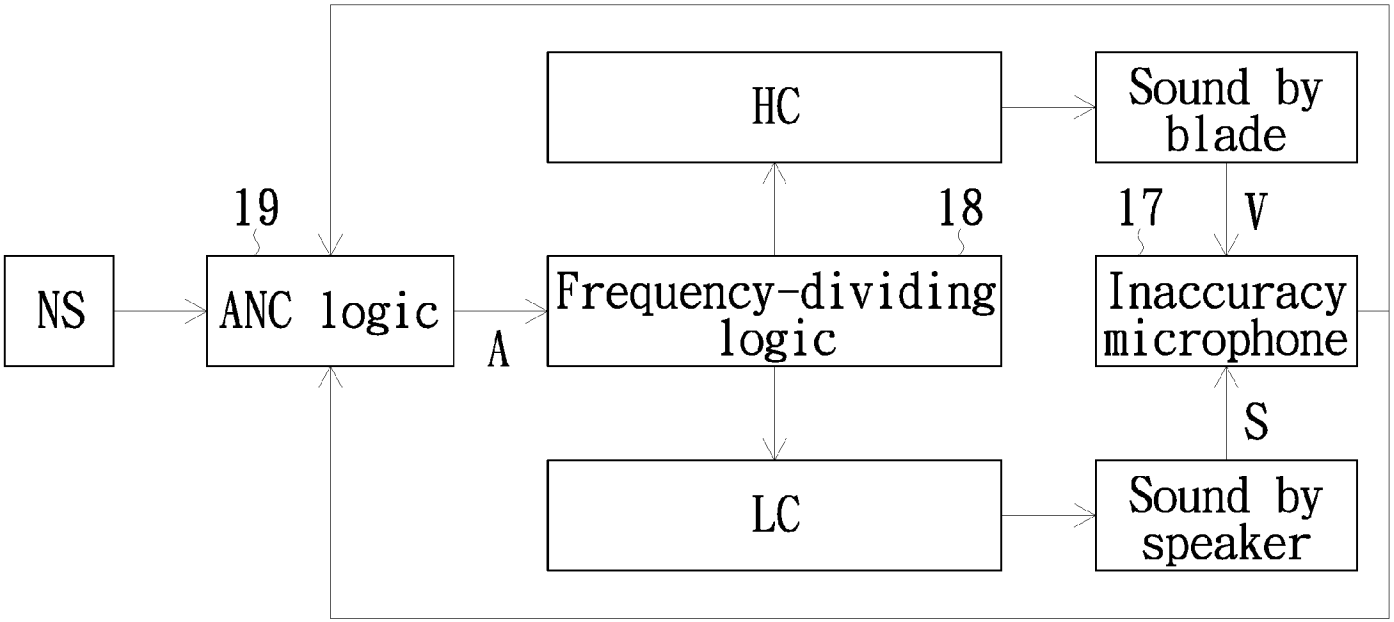
FIG. 2B is a schematic diagram depicting some device's functions and a flow chart of signal processing of a method for reducing fan noise according to another embodiment of the invention.

Referring to FIG. 2A and FIG. 2B, together with FIG. 1A, noise-reducing fan system 1 further comprises a noise-capturing device 17, which may be a microphone, an inaccuracy microphone or the other device with similar function. The noise-capturing device 17 receives a noise N emitted from the fan body 12 as rotating and transforms the same into a noise signal NS, on the other hand, the noise-capturing device 17 may receive feedback voices of a vibration sound V and a noise-reducing sound S when performing noise-reducing, so that the noise-reducing fan system 1 may real-timely adjust strengths of the vibration sound V and the noise-reducing sound S. In order to divide the noise N emitted from the fan body 12 as rotating into a high-frequency noise HN (referring to FIG. 5A) and a low-frequency noise LN (referring to FIG. 5B). The noise-reducing fan system 1 further comprises a frequency-dividing logic circuit 18 which is electrically connected to the noise-capturing device 17. The person of ordinary skill in the art may know that the frequency-dividing logic circuit 18 is composed of chipsets/processors with frequency-dividing logic algorithm, with function of dividing the noise N into the high-frequency noise HN and the low-frequency noise LN. An active noise-reducing circuit 19 is chipsets/processors with active noise-reducing (ANC, active noise cancellation) logic algorithm, electrically connected to the frequency-dividing logic circuit 18, the magnetic field generator 14 and the noise-reducing sound source device 15 (not shown in the drawings), respectively, and commands the magnetic field generator 14 and the noise-reducing sound source device 15 to generate the vibration sound V and the noise-reducing sound S in response to the high-frequency noise HN and the low-frequency noise LN, respectively, wherein the vibration sound V and the noise-reducing sound S are inverse signals of the high-frequency noise HN and the low-frequency noise LN, respectively.

In the embodiment as shown in FIG. 2A, the active noise-reducing circuit 19 comprises a first active noise-reducing circuit 191 and a second active noise-reducing circuit 192, which are electrically connected to the magnetic field generator 14 and the noise-reducing sound source device 15, respectively. After the frequency-dividing logic circuit 18 carries out frequency-dividing of the noise signal NS, they are outputted to the first active noise-reducing circuit 191 and the second active noise-reducing circuit 192, respectively.

Difference between the embodiment as shown in FIG. 2B and the embodiment in FIG. 2A resides in that the active noise-reducing circuit 19 is electrically connected between the noise-capturing device 17 and the frequency-dividing logic circuit 18, so that it is possible to transform the noise signal NS into the inverse sound source signal A firstly, and then, the inverse sound source signal A may be inputted to the frequency-dividing logic circuit 18, and the magnetic field generator 14 and noise-reducing sound source device 15 may be thus controlled by the corresponding frequency-divided high-frequency noise HN and low-frequency noise LN, i.e. the high-frequency inverse control signal HC and low-frequency inverse control signal LC, as two controlling signals, respectively.

Figure 3:
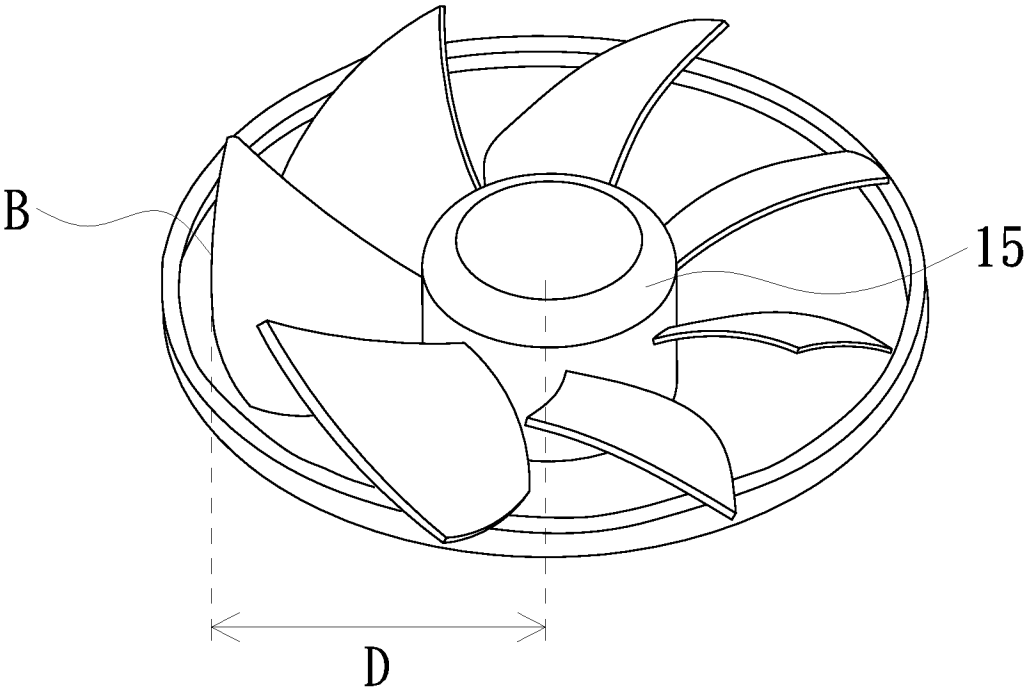
FIG. 3 is a schematic diagram depicting a physical distance between a noise-reducing sound source device and a noise source.

In view that various active noise-reducing technologies have different effects upon the high-frequency noise and the low-frequency noise, the invention's noise-reducing sound S may thus be designed to a lower frequency than the vibration sound V. In order to achieve the effect of noise-reduction, the design of the frequency-dividing logic circuit 18 has been considered, about two following issues:

1. Inverse sound source acoustical device's frequency response graph: Since a physical position of the inverse sound source as generated by the fan body vibration module (including the fan body 12, the magnetic-inducing elements 13 and the magnetic field generator 14) is closer to the noise source B (referring to FIG. 3), therefore, it is possible to overcome a problem of failure in alignment to sonic wave's a phase angle by use of the fan body vibration module as a main inverse sound source. However, depending on fan body vibration module's design discrepancy, it is found that, based on sample's practical experimental data, when the frequency is less than 1000 Hz, frequency's response becomes rather unstable and out of application. At this time, the noise-reducing sound source device 15 may assist in achieving the noise-reducing effect.

2. A physical distance between the noise source B and the inverse voice source and the noise-reducing effect to be achieved when employing the noise-reducing sound source device 15 as the inverse noise source: If phase angles of both of the noise source and the inverse sound source may be completely aligned (0 degree), the noise-reducing effect may be good. However, if a phase difference between the noise source and the inverse sound source reaches 60 degrees, it may be impossible to obtain noise-reducing effect after a mutual interaction of two sonic waves. When a phase difference between the noise source and the inverse sound source becomes larger than 60 degrees, it may disadvantageously incur a greater noise after the mutual interaction of two sonic waves. With a limitation of 60 degrees of phase angle, accompanying with the physical distance between the noise source and the inverse sound source, it is possible to obtain the limitation of the wavelength of voice, together with a speed of voice, so that the limitation of voice's frequency may be calculated. For example, suppose 60 degrees of the phase angle's difference is incurred from the physical distance between the noise source and the inverse sound source, and such a physical distance is about 0.05 m, thus the wavelength of voice is 0.05*360/60=0.3 m. At this time, suppose the speed of voice is 340 m/s, then the limitation of frequency is 340/0.3=1133 Hz. On the demand of noise-reduction, it is possible to adjust the limitation of the phase angle, and a different frequency's limitation may be obtained. Such a frequency's limitation is exactly the predetermined frequency as preset in the frequency-dividing logic circuit. It may be appreciated that, through the above descriptions, the frequency-division between the high-frequency noise HN and the low-frequency noise LN may be performed according to the limitations of physical distance D (referring to FIG. 3) between the noise-reducing sound source device 15 and the noise source B of the noise N emitted from the fan body 12 as rotating, as well as a controlled phase difference of less than 60 degrees between the noise-reducing sound S and the noise source B.

Figure 4A:
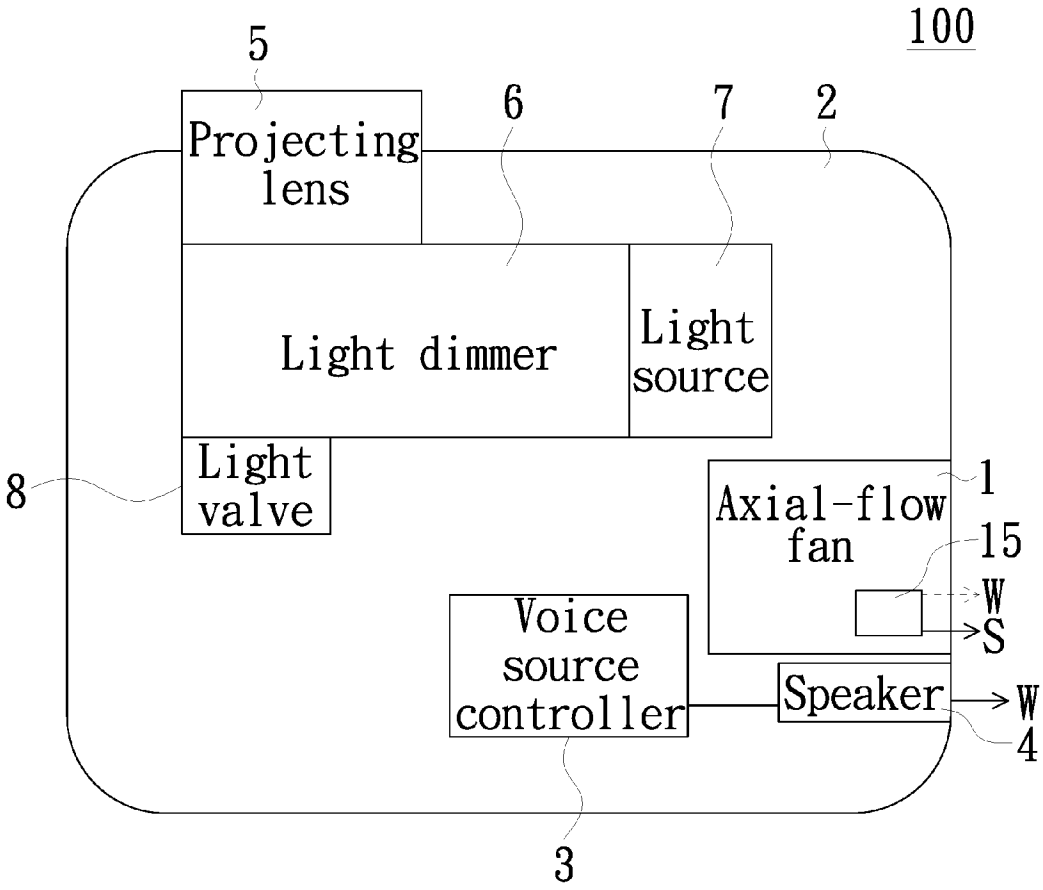
FIG. 4A is a schematic diagram depicting a fan noise reducing system according to an embodiment of the invention being adapted to an electronic device.
Figure 4B:
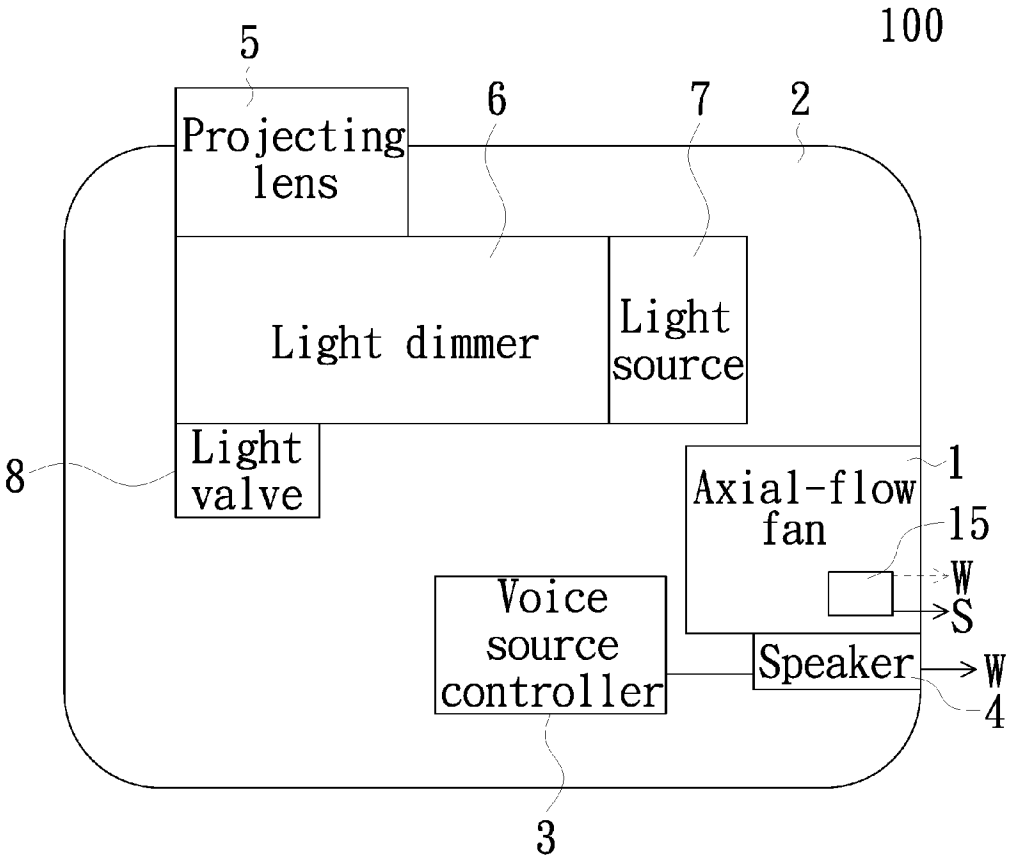
FIG. 4B is a schematic diagram depicting a fan noise reducing system according to another embodiment of the invention being adapted to an electronic device.
Figure 4C:
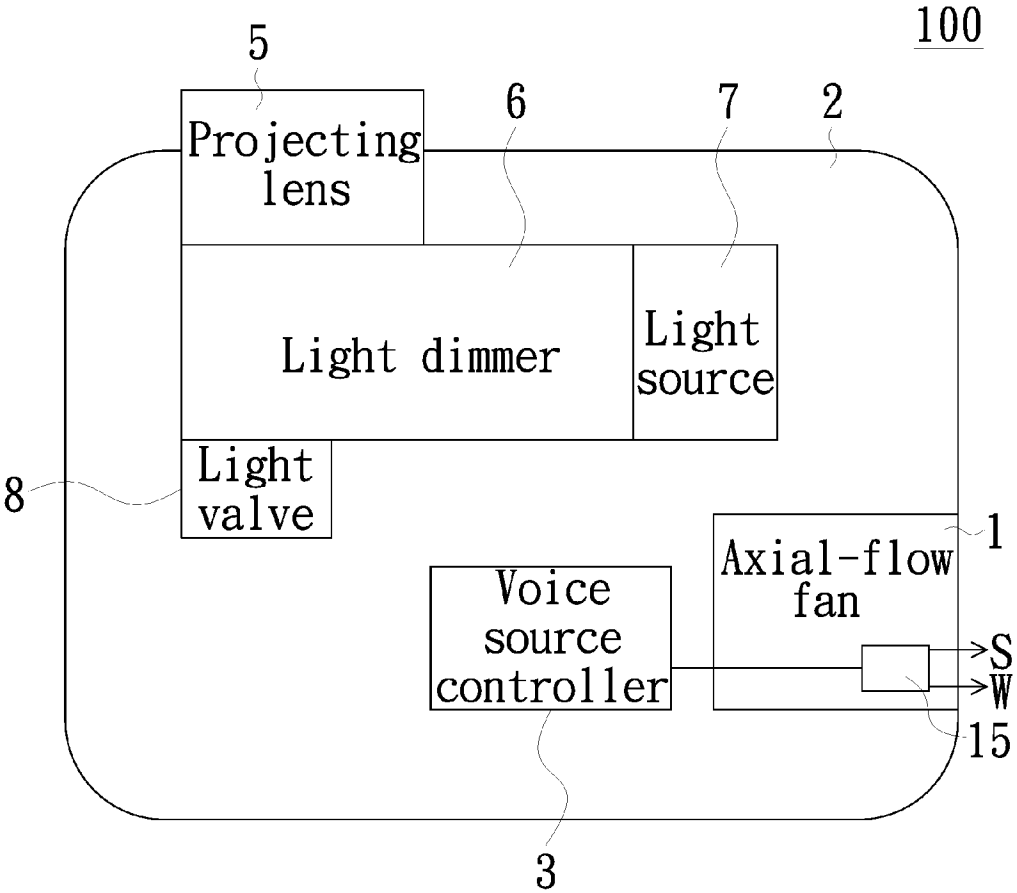
FIG. 4C is a schematic diagram depicting a fan noise reducing system according to still another embodiment of the invention being adapted to an electronic device.

The aforementioned noise-reducing fan system 1 may be mounted in a body 2 of an electronic device 100 as shown in FIG. 4A, FIG. 4B or FIG. 4C. The electronic device 100 may be a projector, provided with a projecting lens 5, a light dimmer 6, a light source 7 and a light valve 8 and so on. In addition to projector, the electronic device 100 may also be the other electron accessories with necessity of heat dissipation and noise-reduction. The noise-reducing fan system 1 may be an axial-flow for heat-dissipation in the projector or the other accessories with necessity of heat dissipation and noise-reduction. In several applications, it is often necessary for the electronic device 100 to send out a voice W, and such a function may be implemented by a voice source controller 3, which is mounted in the device body 2, and a speaker 4, which is electrically connected to the voice source controller 3. Here, the axial-flow fan 1 may be fitted to the speaker 4 (as shown in FIG. 4B) on practical requirement of noise-reduction, or separated from the speaker 4 (as shown in FIG. 4A). In the embodiment as shown in FIG. 4A and FIG. 4B, the noise-reducing sound source device 15 may be selectively electrically connected to the voice source controller 3, so that the speaker 4 may send out the voice W at the same time. That is to say, the noise-reducing sound source device 15 of the axial-flow fan 1 may be employed as a speaker. Further, it is also possible to utilize a software for controlling the frequency-division of the voice to be outputted, depending on voice frequency acoustical efficiency, so as to select either speaker or fan body for serving as a voice output device, alternatively, both of them are selected for outputting a louder volume. Additionally, the voice source controller 3 may be a sound controller or a sound controlling circuit, for example, a sound card or a sound processor, the person of ordinary skill art might know.

Figure 5A:
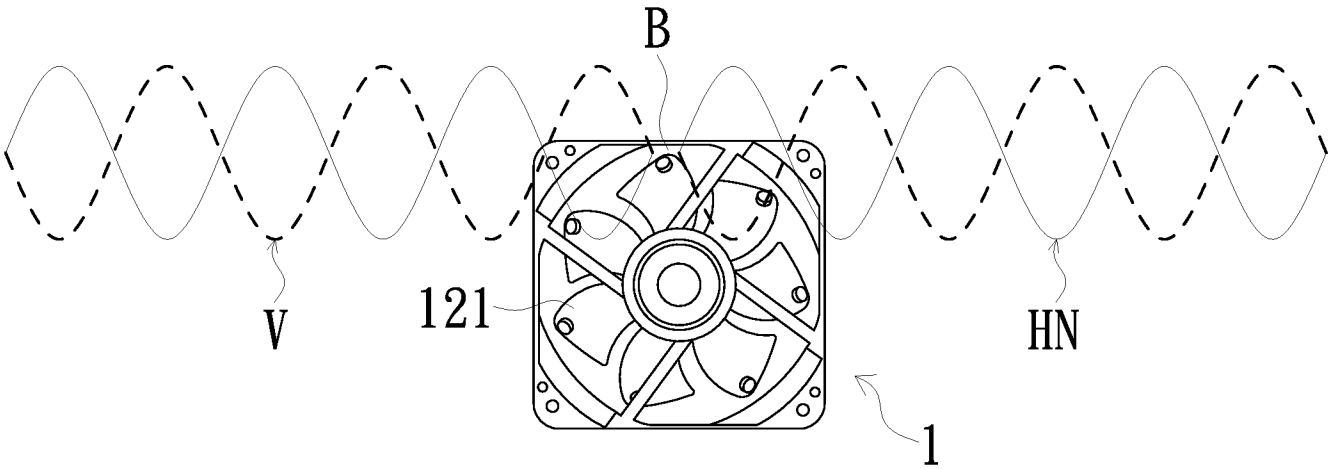
FIG. 5A is a schematic diagram depicting the operation for eliminating high-frequency noise of a fan noise reducing system according to an embodiment of the invention.
Figure 5B:
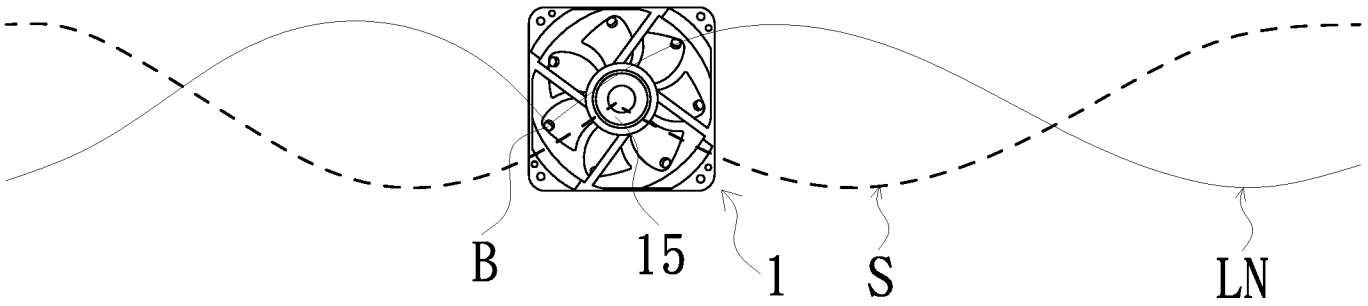
FIG. 5B is a schematic diagram depicting the operation for eliminating low-frequency noise of a fan noise reducing system according to an embodiment of the invention.
Figure 5C:
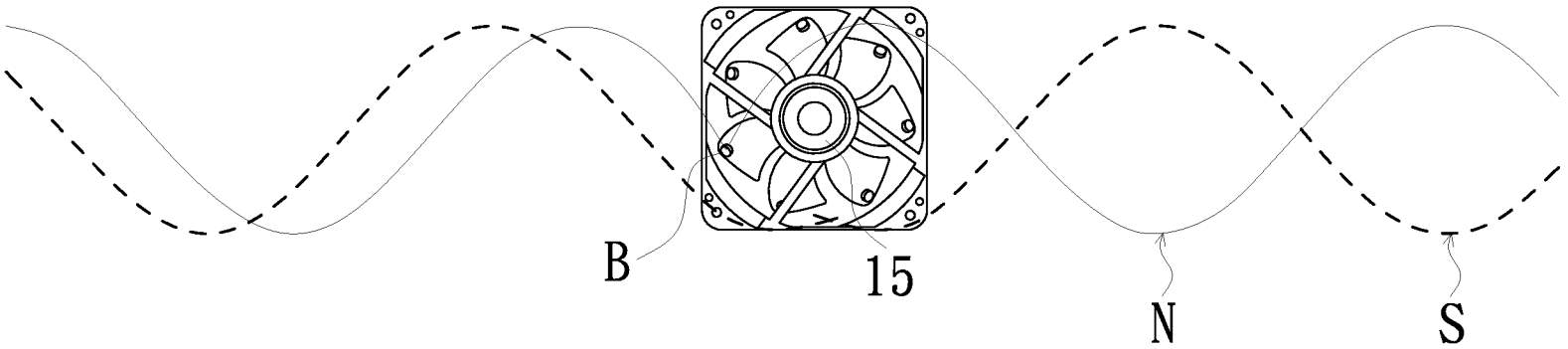
FIG. 5C is a schematic diagram depicting a phase difference between inverse sonic waves emitted from a noise-reducing sound source device of fan noise reducing system and a noise emitted from a noise source according to an embodiment of the invention.

In an embodiment as shown in FIG. 5C, the noise-reducing sound source device 15 is a device functioning as the speaker 4, which may output a noise-reducing sound S and send out a voice W at the same time. It may omit the speaker 4, so that the noise-reducing sound source device 15 may directly function as a speaker, resulting in the reduction of product's complication.

During executing the method for reducing fan noise of the invention, for reduce the noise N generated by the above-described axial-flow fan 1 in its operation, first of all, a frequency, an amplitude and a phase of the noise N are acquired, next, the noise N is divided into a high-frequency noise HN and a low-frequency noise LN; then, a first inverse sound and a second inverse sound are provided, respectively, for the high-frequency noise HN and the low-frequency noise LN, based on an amplitude and a phase of the noise, respectively, so that the high-frequency noise HN and the low-frequency noise LN may be counterbalanced. In an embodiment, the first inverse sound is a vibration sound V as generated by the blades 121 of the fan body 12 to be controlled, and the second inverse sound is a noise-reducing sound S emitted from the noise-reducing sound source device 15.

Timing for dividing the noise N into the high-frequency noise HN and the low-frequency noise LN are different, depending on practical occasions, that is, in the embodiment as shown in FIG. 2A, the noise N is firstly frequency-divided into a high-frequency noise HN and a low-frequency noise LN in a manner of hardware or software, and then, both are inputted to a first active noise-reducing circuit 191 and a second active noise-reducing circuit 192, respectively, for performing an inverse sound source signal calculation on the high-frequency noise HN and the low-frequency noise LN, so that a first inverse sound and a second inverse sound may be sent out by use of different acoustical devices, for example, the blades 121 of the fan body 12 and the noise-reducing sound source device 15. Then, the noise-capturing device 17 may be further employed, for performing a feedback adjustment on the first inverse sound the and second inverse sound. The advantages of signal's processes of the active noise-reducing circuit 19 in this embodiment resides in that it may optimize the process of high- and low-frequency, select a hardware depending on signals to be processed and responding speed.

On the other hand, in the embodiment as shown in FIG. 2B, the active noise-reducing circuit 19 is firstly employed for performing the inverse sound source signal calculation on the noise N so as to obtain the inverse sound source signal A, and then, the inverse sound source signal A is frequency-divided, so that the first inverse sound and the second inverse sound may be sent out by use of different acoustical devices. Then, a feedback adjustment is similarly performed on the first inverse sound and the second inverse sound. Such processes may be simple in logic processing, however, a high-end micro-processor may be required for performing software.

It may be well appreciated that the noise-reducing effect of the invention may be achieved by a relationship of noise and its inverse sound source signal, as illustrated in FIG. 5A to FIG. 5C. For the high-frequency noise HN, as shown in FIG. 5A, since the noise source B and the inverse sound source (the origin of the vibration sound V) are located at the same position (ends of the blades 121), it may reduce the noise's value in all directions, as long as an inverse sound source is generated with a phase completely contrary to those of sonic waves (vibration sound V).

As shown in FIG. 5B, in case of low-frequency noise LN, since there is a distance between the noise source B and the inverse noise source (noise-reducing sound source device 15), taking the fan of 105 mm×105 mm×32 mm as an example, the noise source B is located at ends of the blades 121, and inverse sound source emits from the center of the noise-reducing sound source device 15. Suppose both are point sound source, a distance between such two sound sources is about 50 mm, sonic speed is about 341 m/s at sea-level, 25° C., and the low-frequency signal to be processed is less than 1000 Hz, it may thus obtain the distance between two sound sources is about 15% of the sound's wavelength. Therefore, if the two sound sources generate the same sonic waves at the same time, and a phase difference is adjusted and separated by 180 degrees, as shown in FIG. 5B, although there is a portion of sonic waves may not be counterbalanced in phase. However, most of the sonic waves are counterbalanced in phase, i.e. a quite satisfied noise-reducing effect still may be achieved.

However, if fan's right-side region is a noise-emphasized direction, it is possible to adjust the phase of the inverse noise sonic waves as shown in the next drawing so as to allow the right region to achieve the active noise-reducing effect, however, left-side region's noise may increase. Therefore, such a hybrid active noise-reducing fan may sufficiently utilize the characteristics of high-frequency voice, low-frequency voice and technology of active noise-reduction, so that a flow-field noise generated by the fan may be effectively reduced. Here, although a breakpoint of high-frequency and low-frequency is set at 1000 Hz, however, such a breakpoint of high-frequency and low-frequency should be set based on the distance between the noise source and the inverse sound source and the noise-reducing effect to be achieved. The frequency-division between the high-frequency noise HN and the low-frequency noise LN is carried out, based on a physical distance D between the aforementioned noise-reducing sound source device 15 and a noise source B of noise N emitted from the fan body 12 as rotating, as well as a phase difference R less than 60 degrees between the noise-reducing sound Sand the noise source B.

In summary, according to the invention, fan body vibrations and different inverse sounds, which are caused by a noise-reducing sound source device, such as noise-reducing speaker and so on, are provided in the fan system at the same time. In this way, it is possible to reduce high frequency and low frequency noise values of the fan at the same time, and drastically and substantially improve the effect of active noise-reduction. At the same time, in case that such a fan is adapted to any product with the speaker, such a fan may be directly used as a speaker, resulting in the reduction of product's complication. Once such a fan functions as a speaker, it may be possible to control the voice's frequency-dividing to be output through a software, and select either speaker or fan body served as a voice outputting device depending on a voice frequency acoustical efficiency, alternatively, both of them are selected so as to obtain a louder volume.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations may be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated.

Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which may allow a searcher to quickly ascertain the subject matter of the technical disclosure of any patent issued from this disclosure. It is submitted with the understanding that it may not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the disclosure is intended to be dedicated to the public regardless of whether the element or component is explicitly recited in the following claims.

What is claimed is:

1. A noise-reducing fan system, comprising:

a motor;

a fan body, mounted on the motor, and the fan body adapted to be driven and rotated by the motor, wherein the fan body comprises a plurality of blades;

a plurality of magnetic-inducing elements, disposed on the plurality of blades, respectively;

a magnetic field generator, capable of generating a magnetic field, adapted to drive the plurality of magnetic-inducing elements to vibrate the plurality of blades and generate a vibration sound so as to counterbalance at least a portion of a noise emitted from the fan body as rotating; and a noise-reducing sound source device, capable of sending out a noise-reducing sound, and the noise-reducing sound source device being disposed on a predetermined position, so that the noise-reducing sound counterbalances at least the other portion of the noise emitted from the fan body as rotating.

2. The noise-reducing fan system according to claim 1, further comprising:

a frame body, encircling the fan body, wherein the plurality of magnetic-inducing elements are a plurality of magnetic elements, and the magnetic field generator is attached to the frame body.

3. The noise-reducing fan system according to claim 1, further comprising:

a noise-capturing device, adapted to receive the noise emitted from the fan body as rotating and transform the noise into a noise signal;

a frequency-dividing logic circuit, electrically connected to the noise-capturing device, adapted to divide the noise emitted from the fan body as rotating into a high-frequency noise and a low-frequency noise; and an active noise-reducing circuit, electrically connected to the frequency-dividing logic circuit, the magnetic field generator and the noise-reducing sound source device, adapted to command the magnetic field generator and the noise-reducing sound source device to generate the vibration sound and the noise-reducing sound, respectively, in response to the high-frequency noise and the low-frequency noise, wherein the vibration sound and the noise-reducing sound are inverse signals of the high-frequency noise and the low-frequency noise, respectively.

4. The noise-reducing fan system according to claim 3, wherein the frequency-dividing logic circuit carries out the frequency-dividing of the high-frequency noise and the low-frequency noise based on a physical distance between the noise-reducing sound source device and a noise source of the noise emitted from the fan body as rotating, and a phase difference between the noise-reducing sound and the noise source which is less than 60 degrees.

5. The noise-reducing fan system according to claim 4, wherein the active noise-reducing circuit further comprises a first active noise-reducing circuit and a second active noise-reducing circuit, which are electrically connected to the magnetic field generator and the noise-reducing sound source device, respectively, and wherein the frequency-dividing logic circuit is adapted to send the noise signal to the first active noise-reducing circuit and the second active noise-reducing circuit, respectively, after the frequency-dividing logic circuit carries out the frequency-dividing of the noise signal.

6. The noise-reducing fan system according to claim 4, wherein the active noise-reducing circuit is electrically connected between the noise-capturing device and the frequency-dividing logic circuit, so that the noise signal is transformed into an inverse sound source signal, and the inverse sound source signal is inputted to the frequency-dividing logic circuit, the active noise-reducing circuit is adapted to control the magnetic field generator and the noise-reducing sound source device, respectively, based on the corresponding frequency-divided high-frequency noise and the low-frequency noise as two control signals.

7. An electronic device, comprising:

a noise-reducing fan system, comprising:

a motor;

a fan body, mounted on the motor, and the fan body adapted to be driven and rotated by the motor, wherein the fan body comprises a plurality of blades;

a plurality of magnetic-inducing elements, disposed on the plurality of blades, respectively;

a magnetic field generator, capable of generating a magnetic field, adapted to drive the plurality of magnetic-inducing elements to vibrate the plurality of blades and generate a vibration sound so as to counterbalance at least a portion of a noise emitted from the fan body as rotating; and a noise-reducing sound source device, capable of sending out a noise-reducing sound, and the noise-reducing sound source device being disposed on a predetermined position, so that the noise-reducing sound counterbalances at least the other portion of the noise emitted from the fan body as rotating; and a device body, wherein the noise-reducing fan system is mounted in the device body.

8. The electronic device according to claim 7, further comprising:

a voice source controller, disposed in the device body; and a speaker, electrically connected to the voice source controller, adapted to send out a voice.

9. The electronic device according to claim 8, wherein the noise-reducing sound source device is electrically connected to the voice source controller, so that the speaker is allowed to send out the voice at the same time.

10. The electronic device according to claim 8, wherein the noise-reducing sound source device is the speaker.

11. The electronic device according to claim 8, wherein the electronic device is a projector, and the noise-reducing fan system is an axial-flow fan.

12. A method for reducing fan noise, for reducing a noise generated by a fan in its operation, wherein the fan comprises a fan body provided with a plurality of blades, the method comprising steps of:

acquiring a frequency, an amplitude and a phase of the noise;

dividing the noise into a high-frequency noise and a low-frequency noise; and providing a first inverse sound generated by the plurality of blades vibrated by a plurality of magnetic-inducing elements driven by a magnetic field generator and a second inverse sound generated by a noise-reducing sound source device, respectively, in accordance with the high-frequency noise and the low-frequency noise, as well as the amplitude and the phase of the noise, respectively, so that the high-frequency noise and the low-frequency noise are adapted to be counterbalanced.

13. The method for reducing fan noise according to claim 12, wherein the first inverse sound is a vibration sound generated by the plurality of blades of the fan body to be controlled.

14. The method for reducing fan noise according to claim 13, wherein the second inverse sound is a noise-reducing sound sent out by the noise-reducing sound source device.

15. The method for reducing fan noise according to claim 14, wherein the frequency-dividing of the high frequency noise and the low frequency noise is carried out based on a physical distance between the noise-reducing sound source device and a noise source of the noise emitted from the fan body as rotating and a phase difference between the noise-reducing sound and the noise source which is less than 60 degrees.

16. The method for reducing fan noise according to claim 12, wherein the noise is firstly frequency-divided into the high-frequency noise and the low-frequency noise, and then, an inverse sound source signal calculation is performed for the high-frequency noise and the low-frequency noise, respectively, and the first inverse sound and the second inverse sound are sent out by use of a different acoustical device.

17. The method for reducing fan noise according to claim 16, further comprises a feedback and adjustment step, wherein the feedback and adjustment step comprises receiving feedback voice of the first inverse sound and the second inverse sound and adjusting strengths of the first inverse sound and the second inverse sound.

18. A method for reducing fan noise, for reducing a noise generated by a fan in its operation, wherein the fan comprises a fan body provided with a plurality of blades, the method comprising steps of:

acquiring a frequency, an amplitude and a phase of the noise;

dividing the noise into a high-frequency noise and a low-frequency noise; and providing a first inverse sound and a second inverse sound, respectively, in accordance with the high-frequency noise and the low-frequency noise, as well as the amplitude and the phase of the noise, respectively, so that the high-frequency noise and the low-frequency noise are adapted to be counterbalanced, wherein an active noise-reducing circuit is adapted to perform an inverse sound source signal calculation on the noise so as to obtain an inverse sound source signal, and then, a frequency-dividing is performed for the inverse sound source signal, and the first inverse sound and the second inverse sound are sent out by use of a different acoustical device.

* * * * *